US007187880B2

(12) United States Patent
Senda et al.

(10) Patent No.: US 7,187,880 B2
(45) Date of Patent: Mar. 6, 2007

(54) THERMAL FIXING DEVICE AND IMAGE FORMING APPARATUS USING THE SAME

(75) Inventors: Seiichi Senda, Nagoya (JP); Yasushi Fujiwara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/396,382

(22) Filed: Mar. 26, 2003

(65) Prior Publication Data

US 2003/0202814 A1 Oct. 30, 2003

(30) Foreign Application Priority Data

Mar. 29, 2002 (JP) ..... 2002-095246

(51) Int. Cl.
*G03G 15/20* (2006.01)

(52) U.S. Cl. ..... 399/69; 219/216

(58) Field of Classification Search ..... 399/69, 399/330, 320, 328, 67, 43, 63
See application file for complete search history.

(56) References Cited

U.S. PATENT DOCUMENTS

| | | | | |
|---|---|---|---|---|
| 5,512,993 | A | 4/1996 | Endo et al. | |
| 5,671,462 | A * | 9/1997 | Toyohara et al. | 399/33 |
| 5,682,576 | A * | 10/1997 | Sakai et al. | 399/69 |
| 6,301,454 | B1 * | 10/2001 | Nishida et al. | 399/69 |
| 2003/0059235 | A1 * | 3/2003 | Senda | 399/330 |
| 2003/0185583 | A1 * | 10/2003 | Senda | 399/69 |

FOREIGN PATENT DOCUMENTS

| | | |
|---|---|---|
| JP | 64-84273 | 3/1989 |
| JP | 03-185482 | 8/1991 |
| JP | A 5-6126 | 1/1993 |
| JP | 06-19363 | 1/1994 |
| JP | 06019363 A * | 1/1994 |

(Continued)

OTHER PUBLICATIONS computer translation of cited reference JP7064437a.*

*Primary Examiner*—Quana Grainger
(74) *Attorney, Agent, or Firm*—Oliff & Berridge, PLC

(57) ABSTRACT

Disclosed is a thermal fixing device using at least two heaters for respectively heating center and end portions of a fixing member, in which after the driving of the two heaters is stopped, thermal fixing can be re-started quickly at proper temperatures for both the center and end portions. First, in S100, a judgment is made as to whether the center portion temperature of the thermal roller exceeds 100° C. or not. When it exceeds 100° C., the procedure advances to S110, where the center heater is turned ON two seconds after turning ON the side heater. By thus turning ON the center heater two seconds after the turning ON of the side heater, it is possible to reduce the temperature difference between the two heaters to approximately 8 to 13° C. at the time point when the center heater is turned ON. In this way, the end portions of the thermal roller are heated prior to the center portion thereof, so that, as compared with the case in which the center heater and the side heater are turned ON simultaneously, the temperature difference between these portions is smaller.

21 Claims, 8 Drawing Sheets

FOREIGN PATENT DOCUMENTS

| | | |
|---|---|---|
| JP | A-07-020673 | 1/1995 |
| JP | A 7-64437 | 3/1995 |
| JP | A 08-123230 | 5/1996 |
| JP | A 11-167307 | 6/1999 |
| JP | B2 3121975 | 10/2000 |
| JP | A 2001-272876 | 10/2001 |
| JP | A-2002-318504 | 10/2002 |

* cited by examiner

THERMAL FIXING DEVICE AND IMAGE FORMING APPARATUS USING THE SAME

BACKGROUND OF THE INVENTION

1. Field of the Invention

The present invention relates to a thermal fixing device and an image forming apparatus including the thermal fixing device.

2. Description of the Related Art

In order to thermally fix a toner image transferred to a sheet, an image forming apparatus, such as a laser printer, is usually equipped with a thermal fixing device having a thermal roller and a pressure roller. The toner image transferred to the sheet is thermally fixed while the sheet passes between the thermal roller and the pressure roller. The thermal fixing device also includes a temperature controller that controls temperature along the entire axial length of the thermal roller to within a fixed temperature range.

The following problem arises when the same thermal fixing device is used to thermally fix toner images on two differently sized sheets, that is, both a small size sheet (e.g., A6) and a large size sheet (e.g., A4). Assume that first the thermal fixing device is used to fix toner images on a series of small size sheets. When the sheets contact the thermal roller, the sheets draw heat away from the thermal roller surface that contacts the small size sheets. To insure that temperature of the thermal roller does not drop below the fixed temperature range, the temperature controller controls to heat up the thermal roller at portions in contact with the small size sheet to within the fixed temperature range. Because the temperature controller controls heat across the entire length of the thermal roller, the temperature at non-contacting portions of the thermal roller, that is, the temperature at the two axial end portions of the thermal roller, will increase to higher than the fixed temperature range.

Next, assumed that the thermal fixing device is used to fix toner images on a series of large size sheets. Because the end portions of the thermal roller are excessively hot when they contact the large size sheet, the toner is excessively melted by the hot end portions. The excessively melted toner can stick to the surface of the thermal roller and be transferred onto sheets that are subsequently printed. This is referred to as hot offset.

SUMMARY OF THE INVENTION

FIG. 1 shows a conceivable thermal fixing device capable of thermal fixing images on both a small size sheet 3*a* (e.g., A6) and a large size sheet 3*b* (e.g., A4), without the problem of hot offset.

The thermal fixing device has a thermal roller 26 formed as a cylinder and with a length that corresponds to the width of the maximum size sheet so that thermal fixing can be effected on a sheet of the maximum size acceptable for the image forming apparatus. The thermal roller contains a heater extending across the entire axial length of the heater roller.

The heater includes a center halogen lamp A and an end halogen lamp B. The center halogen lamp A heats a central portion of the thermal roller 26 that corresponds to the width of the small size sheet 3*a*. The end halogen lamp B heats the lengthwise ends of the thermal roller 26, which correspond to the edges of the large sized sheet 3*b*. With this configuration, the heater can fix images on sheets of any size. A temperature sensor 40 is disposed at the border between the center and end halogen lamps A, B for detecting temperature at the surface of the thermal roller 26. Also, a controller 100*c* is provided for controlling drive of the lamps A, B based on the temperature sensor 40.

It can take rather long before printing becomes possible after turning the lamps A and B OFF. FIG. 2 shows an example of the thermal fixing device being back ON after being turned OFF temporarily during a sleep mode or other similar mode for minimizing power consumption of the thermal fixing device when printing is not to be performed for a long period of time.

In this graph, the horizontal axis indicates time, and the vertical axis indicates temperature. The graph shows change in the surface temperature of the thermal roller 26 when the power is turned ON, the two lamps A and B are turned OFF temporarily, and then the two lamps A and B are turned ON again, in this order. Curve A represents the temperature change at the widthwise center portion of the thermal roller 26, that is, at the portion this is heated by the center halogen lamp A, and curve B represents temperature change in the end portions of the thermal roller 26, that is, the portions which have been heated by the end halogen lamp B.

As represented in the graph, while printing is performed the controller 100*c* controls drive of the lamps to maintain the temperatures at center and end portions of the thermal roller 26 at desired temperatures. As a result, a temperature difference D between the center and end portions can be maintained with an acceptable range.

The lamps A and B are turned OFF after printing is completed. As represented in the graph, the end portions as represented by curve A cool more rapidly than the center portion as represented by curve B. This is because heat is drawn from the end portions of the thermal roller 26 through openings near the ends. As a result, the temperature difference between the center and end portions increases after the heaters are turned OFF. Although not shown in the graph, the two temperatures will eventually equalize after a sufficiently long period of time has elapsed. The halogen lamps A and B are simultaneously turned ON again when a new print command comes in. However, if a new print command comes in before the temperatures have equalized, that is, while the temperature difference is rather high, then the temperature difference will still be high by the time one of the center and end temperature (the center temperature in the graph example) reaches the temperature used during image fixation. Furthermore, the temperature rises more slowly at the end portions of the thermal roller than at the center portion. That is, the bearings 44 at the ends of the thermal roller 26 act as heat sinks that draw heat from the end portions of the thermal roller 26. Said differently the support members increase the heat capacity per unit length at the end portions to a value larger than that at the center portion. As a result, the temperature difference will be quite high by the time one of the center and end temperatures reaches the temperature used during image fixation. The temperature difference can be further increased if the lamps A, B are repeatedly turned ON and OFF. Proper fixing cannot be achieved if the temperature difference increases to an excessive value E.

This problem is involved not only in an image forming apparatus using such a thermal fixing device, but also in an apparatus heating a sheet-like member by using a similar thermal fixing device, for example, a laminator.

It is an object of the present invention to provide a thermal fixing device using at least two heaters for respectively heating center and end portions of a fixing member, in which after stopping the driving of the heaters, thermal fixing can be started again at proper temperatures for both the center and end portions.

In order to achieve the above-described objectives, a thermal fixing device according to the present invention includes a fixing member, a main heater, an end heater, and a heater controller. The thermal fixing device performs fixing operations to thermally fix one medium to another medium. The thermal fixing device performs a first fixing operation before a second fixing operation with a non-fixing time interval in between.

The fixing member thermally fixes the medium to the other medium during each fixing operation. The fixing member is elongated in an elongated direction and has a main portion and an end portion aligned side by side with respect to the elongated direction.

The main heater heats the main portion of the fixing member and the end heater heats the end portion of the fixing member.

The heater controller drives the main heater and the end heater to heat up the main portion and the end portion of the fixing member to within a fixing temperature range during the first fixing operation. The heater controller then stops driving the main heater and the end heater during the non-fixing interval. The heater controller then drives the end heater at start of the second fixing operation, waits for a time lag to elapse after starting drive of the end heater, and then drives the main heater after the time lag elapses.

An image forming device according to the present invention includes an image forming unit, a thermal fixing device, and a thermal fixing device controller. The image forming unit performs a prior image forming operation and a subsequent image forming operation consecutively to form images on recording media. The image forming unit performs the prior image forming operation before performing the subsequent image forming operation.

The thermal fixing device thermally fixes the images onto the recording medium. The thermal fixing device includes a fixing member, a main heater, and an end heater. The fixing member thermally fixes the medium to the other medium. The fixing member is elongated in an elongated direction and has a main portion and an end portion aligned side by side with respect to the elongated direction. The main heater heats the main portion of the fixing member and the end heater that heats the end portion of the fixing member. The thermal fixing device controller selectively turns the main heater and the end heater on while the image forming unit performs the prior image forming operation and off after the image forming unit completes the prior image forming operation. Then, before the image forming unit performs the subsequent image forming operation, the thermal fixing device controller turns the end heater on before turning the main heater on.

A method according to the present invention is for controlling a thermal fixing device. The thermal fixing device includes a fixing member, a main heater, and an end heater. The fixing member thermally fixes one medium to another medium. The fixing member is elongated in an elongated direction and has a main portion and an end portion aligned side by side with respect to the elongated direction. The main heater heats the main portion of the fixing member and the end heater heats the end portion of the fixing member The method includes driving the main heater and the end heater to heat up the main portion and the end portion of the fixing member to within a fixing temperature range to perform a first fixing operation, stopping drive of the main heater and the end heater during a non-fixing interval after the first fixing operation is completed, driving the end heater at start of a second fixing operation after the first fixing operation and the non-fixing interval, waiting for a time lag to elapse after starting drive of the end heater at start of the second fixing operation, and driving the main heater after the time lag elapses.

BRIEF DESCRIPTION OF THE DRAWINGS

In the accompanying drawings:

FIG. 2 is a graph showing temperature changes at center and end portions of a thermal roller of the conceivable thermal fixing device of FIG. 1 when heating lamps in the thermal roller are turned OFF and then back ON;

DETAILED DESCRIPTION OF THE PREFERRED EMBODIMENT

Figure 1:
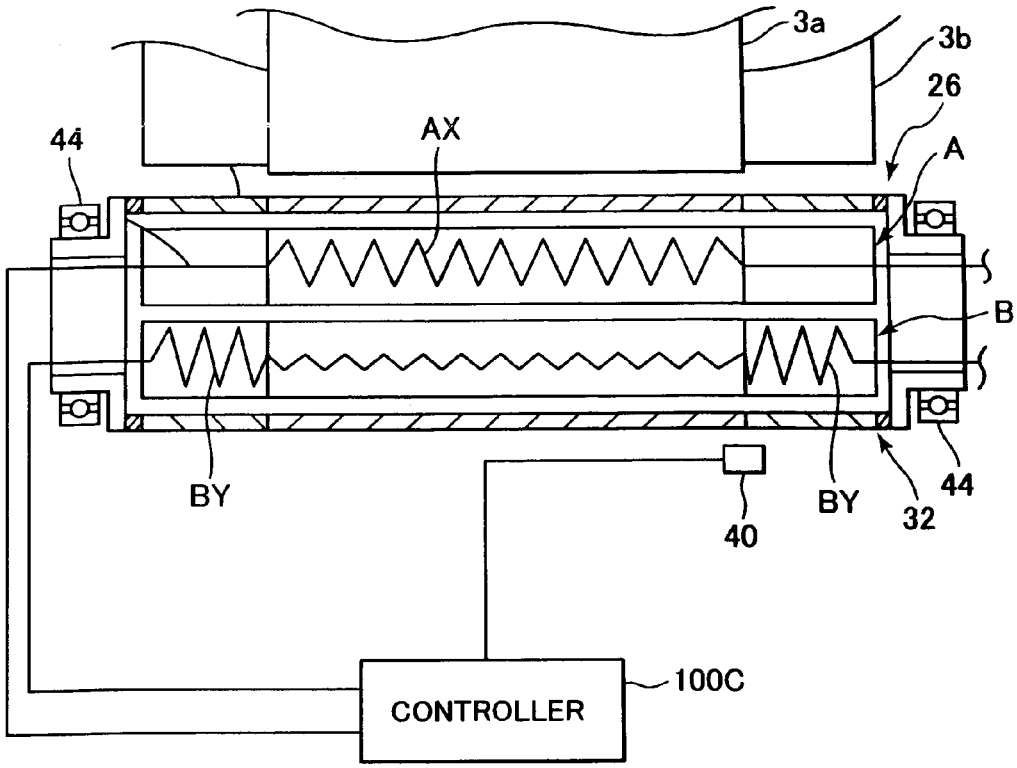
FIG. 1 is a sectional view showing a conceivable thermal fixing device.
Figure 2:
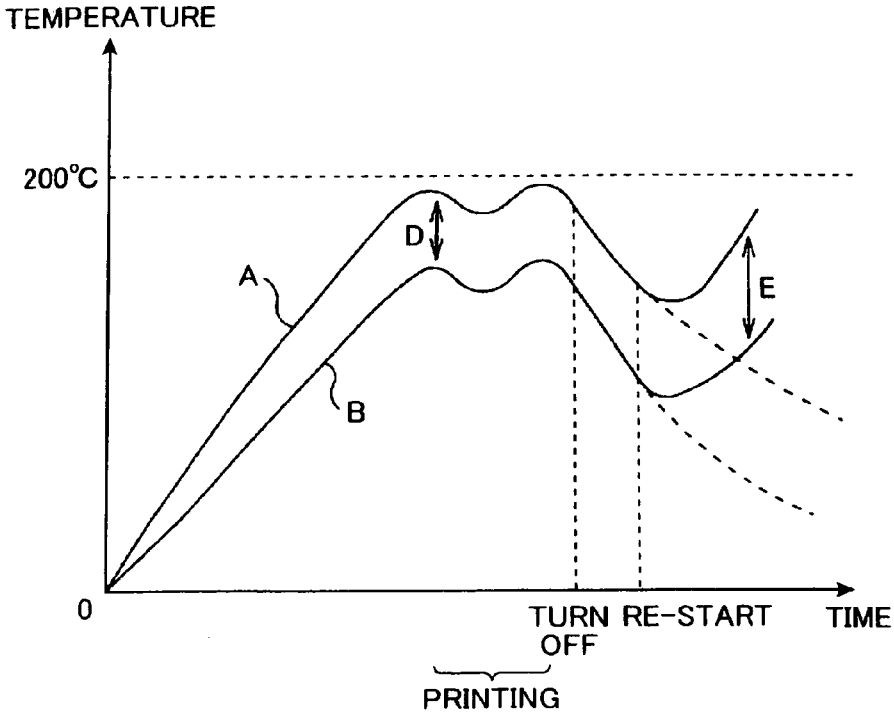
Figure 3:
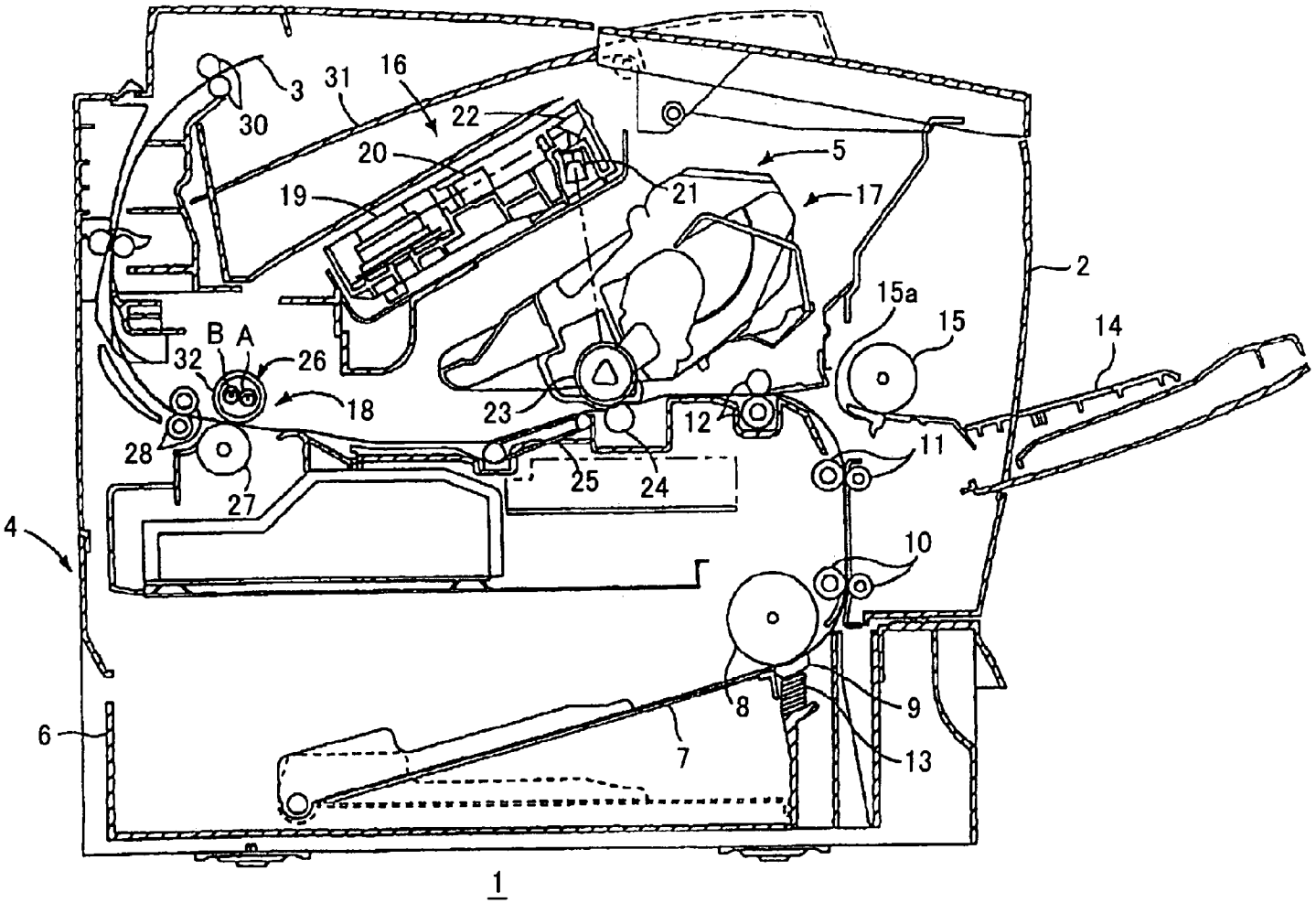
FIG. 3 is a sectional view showing a laser printer according to an embodiment of the present invention.

In the following, a laser printer 1 according to an embodiment of the present invention will be described. As shown in FIG. 3 the laser printer 1 includes a main body casing 2, a feeder portion 4, an image forming portion 5, and a thermal fixing device 18. The feeder portion 4, the image forming portion 5, and the thermal fixing device 18 are housed within the casing 2. The feeder portion 4 is for feeding sheets 3 to the image forming portion 5. The image forming portion 5 forms toner images on the sheets 3 from the feeder portion 4. The thermal fixing device 18 is for thermally fixing the toner images onto the sheets.

The feeder portion 4 is located at the bottom of the main body casing 2 and includes a detachable sheet feeding tray 6, a sheet pressing plate 7, a sheet feeding roller 8, a sheet feeding pad 9, transport rollers 10 and 11, and registration rollers 12 The sheet pressing plate 7 is provided in the sheet feeding tray 6. The sheet feeding roller 8 and the sheet feeding pad 9 are provided above one end portion of the sheet feeding tray 6. The transport rollers 10 and 11 are provided downstream from the sheet feeding roller 8 with respect to the transporting direction for the sheet 3. Hereinafter, upstream and downstream with respect to the transporting direction for the sheet 3 will be simply referred to as upstream and downstream. The registration rollers 12 are provided downstream from the transport rollers 10 and 11.

The sheet pressing plate 7 supports sheets 3 in a stack. The sheet pressing plate 7 is swingably supported at the end farther from the sheet feeding roller 8 to thereby make the end nearer to the sheet feeding roller 8 vertically movable. Further, the sheet pressing plate 7 is upwardly urged from the back side by a spring (not shown). Thus, as the number of sheets 3 stacked increases, the sheet pressing plate 7 is swung downwardly against the urging force of the spring, using the end farther from the sheet feeding roller 8 as the fulcrum. The sheet feeding roller 8 and the sheet feeding pad 9 are opposed to each other, and the sheet feeding pad 9 is pressed against the sheet feeding roller 8 by a spring 13 arranged on the back side of the sheet feeding pad 9. The uppermost sheet 3 on the sheet pressing plate 7 is pressed against the shoot feeding roller 8 from the back side of the sheet pressing plate 7 by a spring (not shown), and is caught between the sheet feeding roller 8 and the sheet feeding pad 9 through the rotation of the sheet feeding roller 8, the sheets being fed one by one. The fed sheet 3 is sent to the registration rollers 12 by the transport rollers 10 and 11. The registration rollers 12 are adapted to send the sheet 3 to the image forming position after effecting a predetermined registration operation. The image forming position is the transfer position where a toner image on a photosensitive drum 23 is transferred to the sheet 3 and, in this embodiment, is the position where the photosensitive drum 23 and a transfer roller 24 are in contact with each other.

The feeder portion 4 is further equipped with a multi-purpose tray 14, a multi-purpose sheet feeding roller 15 for feeding the sheets 3 stacked on the multi-purpose tray 14, and a multi-purpose sheet feeding pad 15*a*. The multi-purpose sheet feeding roller 15 and the multi-purpose sheet feeding pad 15*a* are opposed to each other, and the multi-purpose sheet feeding pad 15*a* is presses against the multi-purpose sheet feeding roller 15 by a spring (not shown) arranged on the back side of the multi-purpose sheet feeding pad 15*a*. The sheets 3 stacked on the multi-purpose tray 14 are fed one by one after being caught between the multi-purpose sheet feeding roller 15 and the multi-purpose sheet feeding pad 15*a* through rotation of the multi-purpose sheet feeding roller 15.

The image forming portion 5 includes a scanner unit 16, a process cartridge 17, and the transfer roller 24.

The scanner unit 16 is provided in the upper portion of the interior of the main body casing 2, and includes a laser emitting portion (not shown), a rotationally driven polygon mirror 19, lenses 20 and 21, and a reflection mirror 22. A laser beam based on image data emitted from the laser emitting portion is passed through or reflected by the polygon mirror 19, the lens 20, the reflection mirror 22, and the lens 21 in that order as indicated by the chain line in FIG. 3 and scanned at a high speed across the surface of the photosensitive drum 23 of the process cartridge 17 described below.

The process cartridge 17 is arranged below the scanner unit 16, and is detachable with respect to the main body casing 2. Although not shown, the process cartridge 17 further includes a scorotron charger, a developing roller, and a toner accommodating portion.

The toner accommodating portion is filled with a positively charging, non-magnetic single-component polymer toner as the developer, and the toner is borne on the developing roller in a thin layer of uniform thickness.

The photosensitive drum 23 is rotatably arranged opposite to the developing roller. The drum main body is grounded, and the surface thereof is formed by a positively charged photosensitive layer formed of polycarbonate and the like.

As the photosensitive drum 23 rotates, the surface of the photosensitive drum 23 is charged positively and uniformly by the scorotron charger, and then is exposed through high speed scanning with the laser beam from the scanner unit 16. The electric potential at the surface of the photosensitive drum 23 drops at positions exposed by the laser beam, thus forming an electrostatic latent image based on predetermined image data on the surface of the photosensitive drum 23. Thereafter, when the latent image is rotated into confrontation with the developing roller, the toner borne on the developing roller shifts to the electrostatic latent image on the surface of the photosensitive drum 23 to develop the electrostatic latent image into a visual toner image, thereby achieving reversal development.

The transfer roller 24 is rotatably supported below and in confrontation with the photosensitive drum 23. The transfer roller 24 is formed by coating a metal roller shaft with a conductive rubber material, and a predetermined transfer bias is applied thereto with respect to the photosensitive drum 23. The visible toner image borne on the photosensitive drum 23 is transferred to the sheet 3 while the sheet 3 passes between the photosensitive drum 23 and the transfer roller 24. The sheet 3 to which the visible image has been transferred is transported through a transport belt 25 to the thermal fixing device 18 described below.

This laser printer 1 is capable of performing printing on a small size sheet 3 (hereinafter referred to as the small size sheet 3*a*) and a large size sheet 3 (hereinafter referred to as the large size sheet 3*b*), and the thermal fixing device 18 is accordingly designed so as to allow fixing on the small size sheet 3*a* and the large size sheet 3*b*. In the following, the specific structure and control for performing fixing on the small size sheet 3*a* and the large size sheet 3*b* by this thermal fixing device 18 will be described in detail. In the present embodiment, an A5 vertical sheet and an A6 horizontal sheet (having a width of 148 mm) are examples of the small size sheet 3*a* and an A4 vertical sheet (having a width of 209 mm) is an example of the large size sheet 3*b*.

The thermal fixing device 18 is arranged downstream from the process cartridge 17, and includes a thermal roller 26, a pressure roller 27, and transport rollers 28. The pressure roller 27 confronts and presses against the thermal roller 26, with the transport path for the sheet 3 interposed between the pressure roller 27 and the thermal roller 26. The transport rollers 28 are provided downstream from the thermal roller 26 and the pressure roller 27.

The thermal roller 26 includes a cylindrical aluminum roller main body 32, a center halogen lamp A, and a end halogen lamp B. The roller main body 32 is rotatably mounted on bearings 44 so as to rotate about an imaginary axis of rotation.

Figure 4:
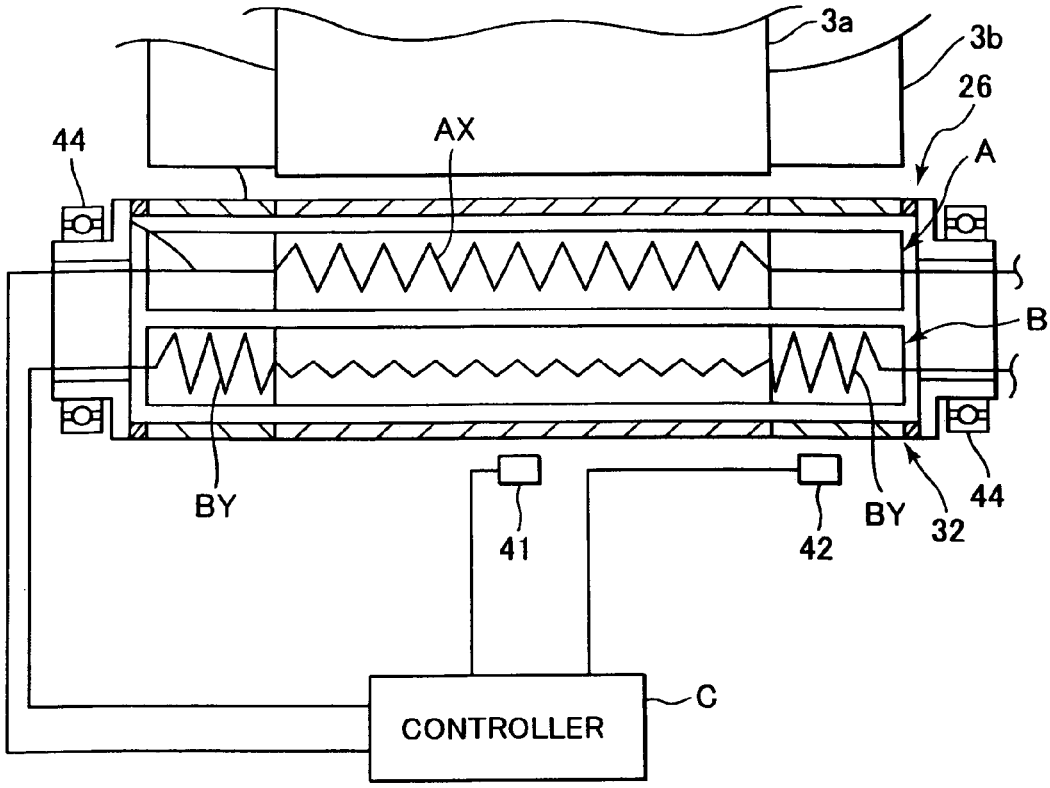
FIG. 4 is a sectional view showing a thermal fixing device of the laser printer of FIG. 3.

As shown in FIG. 4, the center halogen lamp A and the end halogen lamp B both extend across the entire axial length of the roller main body 32 and are arranged in parallel with each other on opposites sides of the axis of rotation. The lamps A and B are stationary. As a result, the roller main body 32 rotates around the lamps A, B. The center halogen lamp A has a heating region AX that is near the center of the roller main body 32 with respect to the axial length of the roller main body 32. The heating region AX has a length, with respect to the axial length of the roller main body 32, that is substantially the same as the width of the small sized sheet 3*a*. Said differently, the light distribution of the center halogen lamp A generates the greatest heat at the heating region AX, thereby heating up the center region of the roller main body 32. The end halogen lamp B has heating regions BY that are near the ends of the roller main body 32 with respect to the axial length of the roller main body 32. Said differently, the heating regions BY are located to the outside of the heating region AX and within the range of the width of the large sized sheet 3*a*. The light distribution of the end halogen lamp B generates the greatest heat at the heating regions BY. It should be noted that the portion of each of the halogen lamps A, B that generates the greatest heat is alternately referred to as the heat peak portion of the lamp. The heat generated by the center halogen lamp A and the end halogen lamp B heats the roller main body 32.

Referring back to FIG. 3, the pressure roller 27 is composed of a metal roller shaft and a roller of an resilient material covering the metal roller shaft. The pressure roller 27 presses against the thermal roller 26 with a predetermined force.

The thermal fixing device 18 thermally fixes the toner image transferred to the sheet 3 in the process cartridge 17 while the sheet 3 passes between the thermal roller 26 and the pressure roller 27.

The sheet 3 which has undergone fixing in the thermal fixing device 18 is then transported to the transport rollers 28 provided downstream from the thermal fixing device 18 and to transport rollers 29 and discharge rollers 30 provided downstream from the transport rollers 28 before being discharged onto a discharge tray 31 by the discharge rollers 30.

As shown in FIG. 4, the thermal fixing device 18 further includes a first temperature sensor 41 and a second temperature sensor 42. The first temperature sensor 41 is located at a position of the thermal roller 26 that corresponds to the heat peak portion of the center halogen lamp A and measures a center portion temperature $T_{cent}$ near the center of the thermal roller 26. The second temperature sensor 42 is located at a position that corresponds to the heat peak portion of the end halogen lamp B and measures an end portion temperature $T_{end}$ near the end of the thermal roller 26

Further, a controller C is provided for reading the temperatures $T_{cent}$, $T_{end}$ detected by the sensors 41 and 42 and selectively turning ON and OFF the center halogen lamp A and the end halogen lamp B to control the temperature of the roller main body 32.

Figure 6:
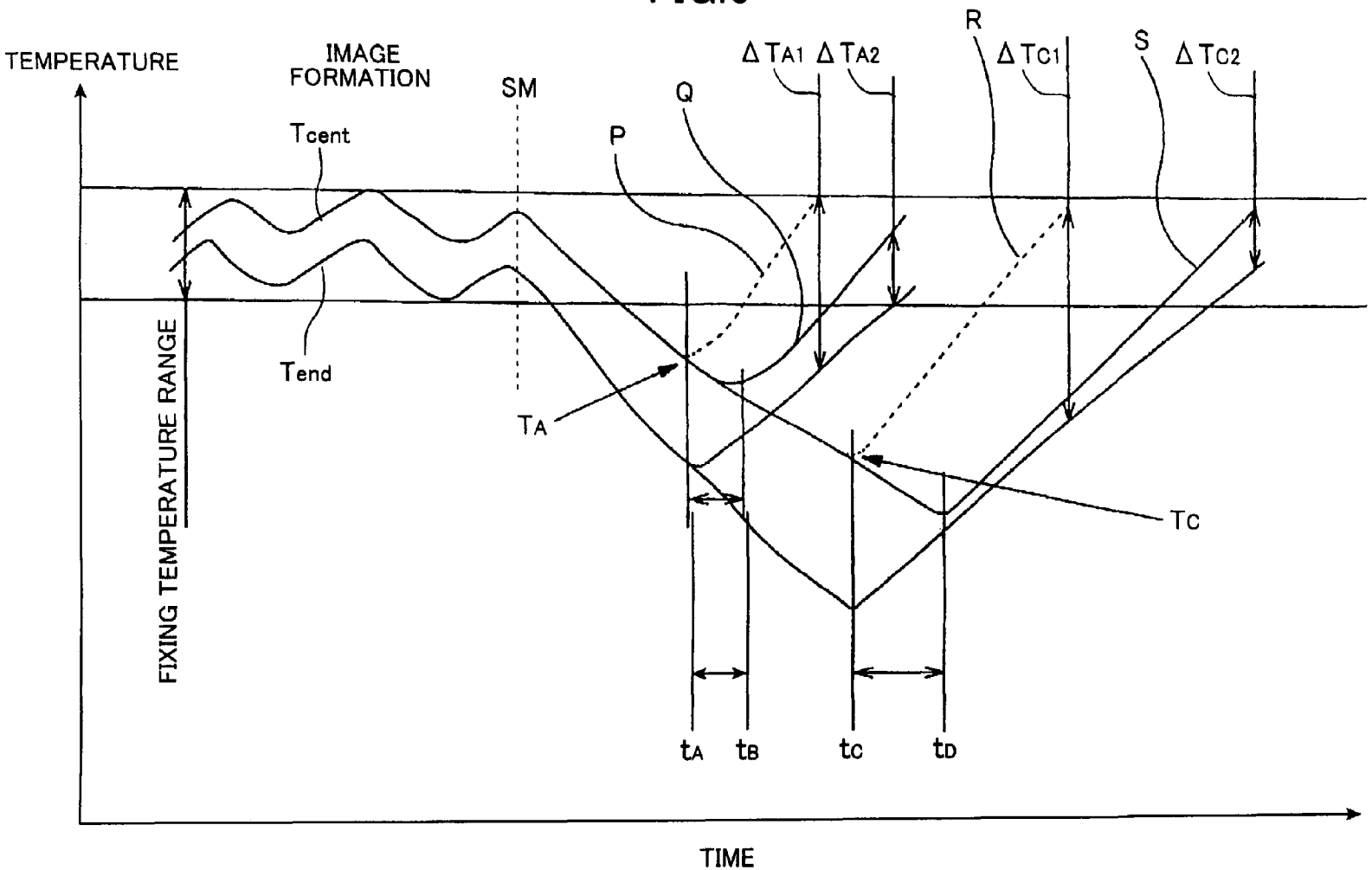
FIG. 6 is a graph representing changes in temperature at center and end portions of a thermal roller in the thermal fixing device of FIG. 4.

Next, operations of the thermal fixing device 18 will be describe with reference to the graph of FIG. 6. During image formation, wherein the image forming portion 5 is forming images, the controller C controls selectively turns the first and end halogen lamps A, B ON and OFF to maintain the temperatures $T_{cent}$, $T_{end}$ of the thermal roller 26 within a fixing temperature range. The fixed temperature range is the temperature range wherein toner is properly fused to the sheets 3 by the thermal roller 26. Once image formation is completed, then the image forming device 1 enters a temporary sleep mode at timing SM. At this time (or after a predetermined time lag to take into account the possibility of a subsequent image forming operation being immediately performed), the controller C simultaneously turns OFF the first and end halogen lamps A, B. As a result, the temperatures $T_{cent}$, $T_{end}$ of the thermal roller 26 gradually decreases as the thermal roller 26 cools. However, it should be noted that the end portion of the thermal 26 cools faster than the center portion, so the end portion temperature $T_{end}$ drops faster than the center portion temperature $T_{cent}$.

Figure 5:
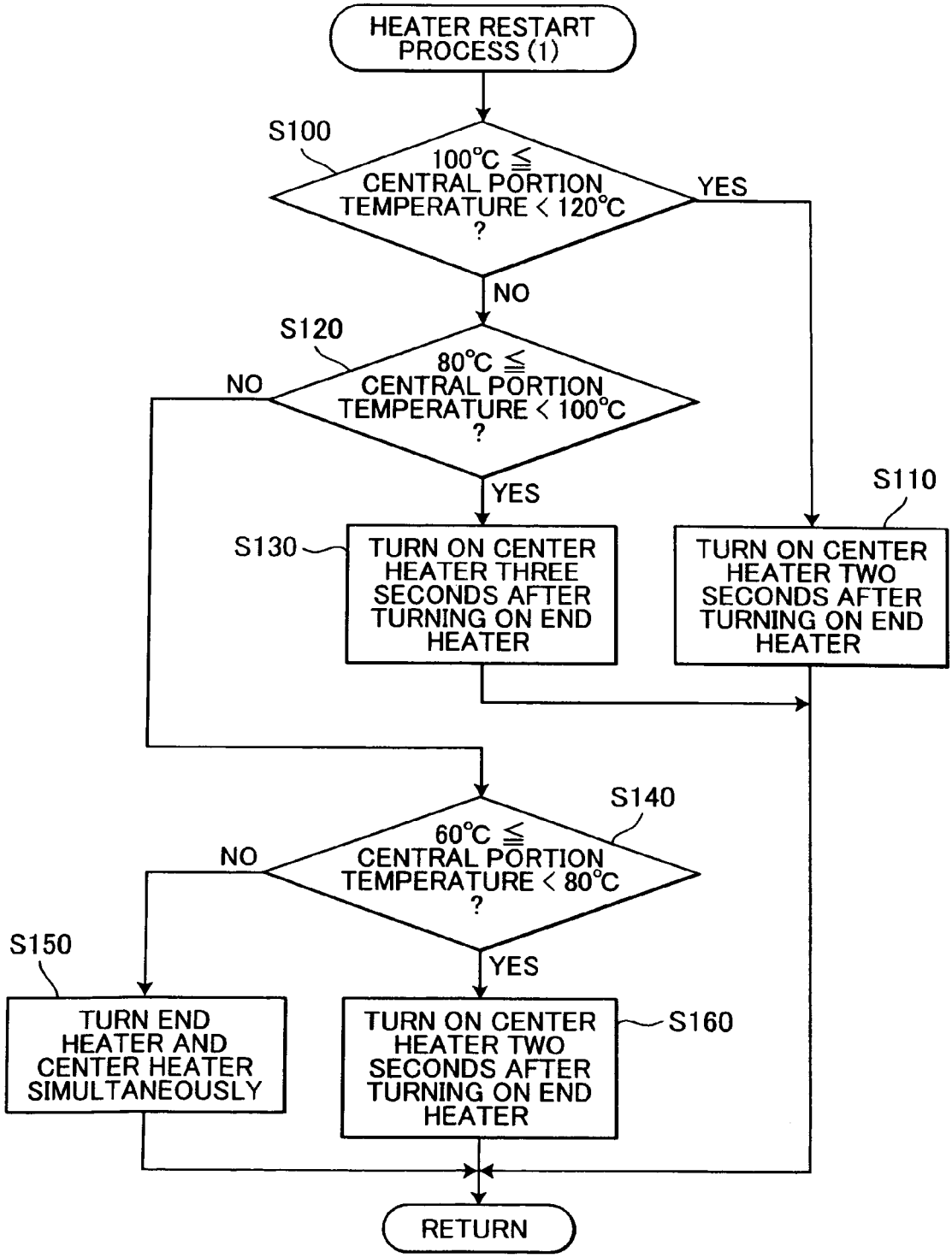
FIG. 5 is a flowchart representing a heater restart process (1) of the thermal fixing device of FIG. 4.

Next, a heater restart process (1) represented by the flowchart of FIG. 5 is started up. The heater restart process (1) is started when a subsequent image forming operation is to be performed after the first and end halogen lamps A and B have been turned OFF in the manner described above. When this process is started, a judgment is first made in step (hereinafter abbreviated to S) 100 as to whether the center portion temperature $T_{cent}$ of the thermal roller 26, as detected by the first temperature sensor 41, is in the range from 100° C. to less than 120° C.

When the center portion temperature $T_{cent}$ is in the range from 100° C. to less than 120° C., then it is expected that the difference between the center portion temperature $T_{cent}$ and the end portion temperature $T_{end}$ will fairly large. If the first and end halogen lamps were turned on at the same time in this condition, then center portion temperature $T_{cent}$ will exceed the fixing temperature range before the end portion temperature $T_{end}$ increases to enter the fixing temperature range. For example, if the center halogen lamp A and the end halogen lamp B are turned ON simultaneously at time point $t_A$ while the center portion temperature $T_{cent}$ is at a temperature of 110° C. ($T_A$), then the center portion temperature $T_{cent}$ will increase as indicated by the broken line P to greater than the upper limit of the fixing temperature range before the end portion temperature $T_{end}$ has even attained the lower limit of the fixing temperature range. At the time that the center portion temperature $T_{cent}$ exceeds the upper limit of the fixing temperature range, the temperature difference $\Delta T_{A1}$ between the center portion temperature $T_{cent}$ and the end portion temperature $T_{end}$ will be about 15 to 20° C. This exceeds the desirable temperature difference during printing, which is less than 15° C.

Therefore, according to the present embodiment, when the center portion temperature $T_{cent}$ is in the range from 100° C. to less than 120° C. (S100:YES), then the procedure advances to S110, whereupon the end halogen lamp B is turned ON first, and then the center halogen lamp A is turned ON after a delay of two seconds. As a result, the center portion temperature $T_{cent}$ rises as indicated by the solid line Q so that the center portion temperature $T_{cent}$ will still be within the fixing temperature range by the time the end portion temperature $T_{end}$ enters the fixing temperature range. The temperature difference $\Delta T_{A2}$ at this time will only be about 8 to 13° C.

When the center portion temperature $T_{cent}$ is not in the range from 100° C. to less than 120° C. (S100:NO), the procedure advances to S120, where a judgment is made as to whether the center portion temperature $T_{cent}$ is in the range from 80° C. to less than 100° C.

Turning again to FIG. 6, at the time point $t_c$ the center portion temperature $T_{cent}$ is within the range from 80° C. to less than 100° C., more specifically at a temperature $T_c$ of about 90° C. If the center halogen lamp A and the end halogen lamp B is turned ON simultaneously at this time, then as indicated by the broken line S the center portion temperature $T_{cent}$ will have reached the upper limit of the fixing temperature range before the end portion temperature $T_{end}$ is high enough to enter the fixing temperature range. At this time, the difference $\Delta T_{C1}$ between the center portion temperature $T_{cent}$ and the end portion temperature $T_{end}$ is even larger than the temperature difference $\Delta T_{A1}$. When the center portion temperature of the thermal roller 26 is 90° C., the difference between it and the end portion temperature of the thermal roller 26 can be as large as 20 to 25° C. Therefore, the two second delay used in S110 is insufficient to reduce the temperature difference to less than 15° C.

For this reason, according to the present embodiment, when center portion temperature $T_{cent}$ is in the range from 80° C. to less than 100° C. (S120:YES), the procedure advances to S130, where the center halogen lamp A is turned ON at time $t_D$, which is three seconds after the time $t_C$ when the end halogen lamp B is turned ON. By turning ON the center halogen lamp A three seconds after the end halogen lamp B, the center portion temperature $T_{cent}$ rises as indicated by the solid line S, and it is possible to reduce the temperature difference $\Delta T_{C2}$ to approximately 5 to 8° C. by the time the end portion temperature $T_{end}$ enters the fixing temperature range. Thus, when the center portion temperature $T_{cent}$ has attained a temperature where fixing can be properly performed, the end portion temperature $T_{end}$ is also within the fixing temperature range, that is, the temperature difference is less than 15° C.

When the center portion temperature $T_{cent}$ is not in the range of from 80° C. to less than 100° C. (S120:NO), the procedure advances to S140, where a judgment is made as to whether the center portion temperature $T_{cent}$ is in a range from 60° C. and less than 80° C. When it is in the range from 60° C. and less than 80° C., the procedure advances to S160, where the center halogen lamp A is turned ON two seconds after turning ON the end halogen lamp B. Although the center portion of the thermal roller 26 is cooler in this case than when S120 is an affirmative judgment, the center halogen lamp P is turned after a shorter delay (two seconds as opposed to three second) for the following reason.

Figure 7:
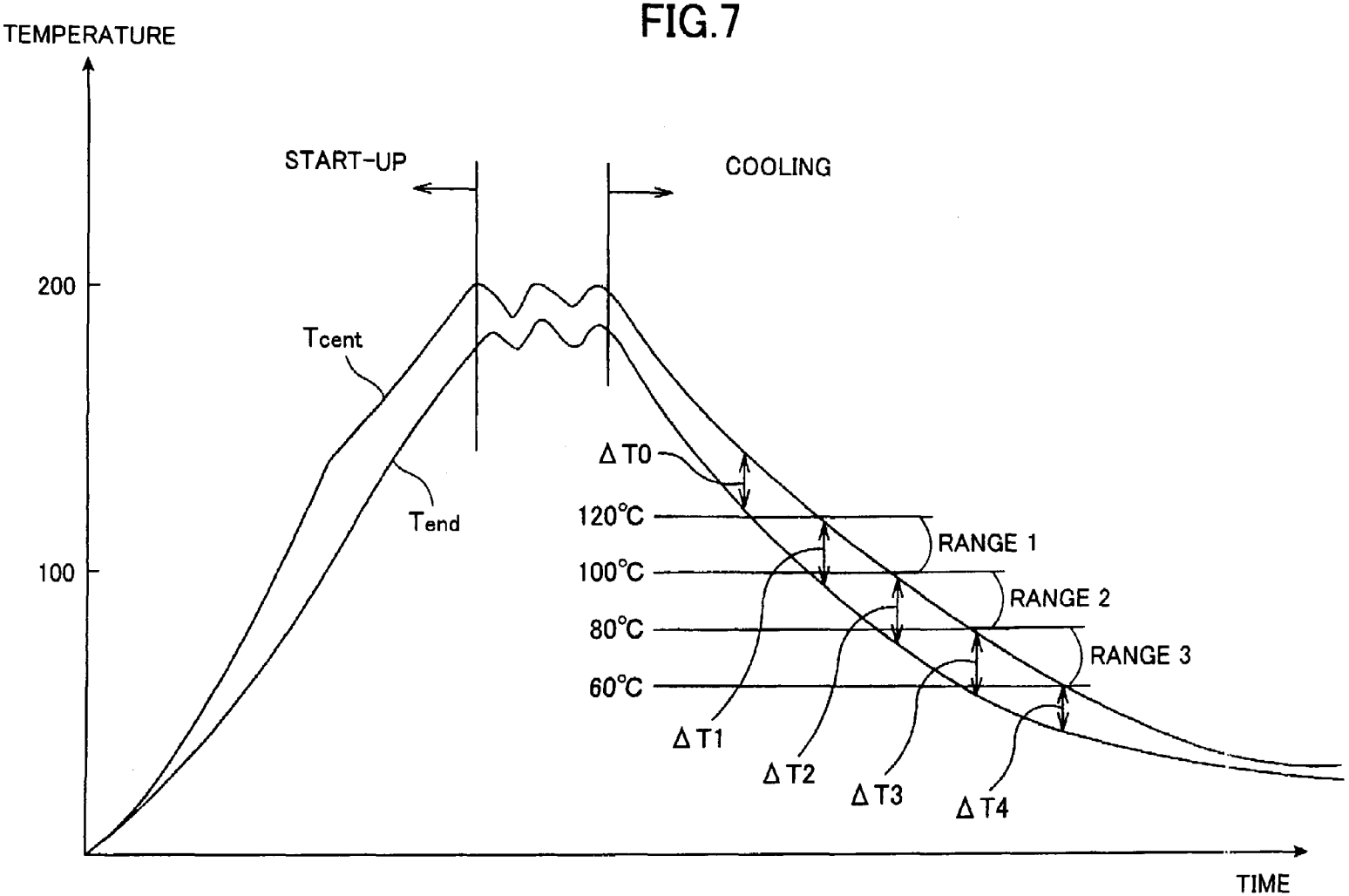
FIG. 7 is a graph representing temperature changes of the thermal roller when center and end heating lamps of the thermal fixing device of FIG. 4 are turned OFF simultaneously.

When the center portion temperature $T_{cent}$ of the thermal roller 26 has cooled to the range from 60° C. and less than 80° C., then the difference between the center portion temperature $T_{cent}$ and the end portion temperature $T_{end}$ will be less than when the center portion temperature $T_{cent}$ is in the temperature ranges from 100° C. to less than 120° C. and from 80° C. to less than 100° C. The graph of FIG. 7 shows the situation of when the center halogen lamp A and the end halogen lamp B are turned OFF simultaneously after printing (after being started up and heated). Actually, the requisite time for cooling is considerably longer than the requisite time for starting up. The drawing is exaggerated for purpose of illustration. As can be seen in FIG. 7, the temperature difference between the center portion temperature $T_{cent}$ and the end portion temperature $T_{end}$ of the thermal roller 26 is small at first, grows gradually larger, and then grows gradually less. More specifically, the change in temperature difference between center portion temperature $T_{cent}$ and the end portion temperature $T_{end}$ of the thermal roller 26 can be represented by the following formula:

$$\Delta T2>\Delta T1,\ \Delta T3>\Delta T0,\ \Delta T4$$

wherein $\Delta T0$ is the temperature difference while the center portion temperature $T_{cent}$ is greater than or equal to 120° C., $\Delta T1$ is the temperature difference while the center portion temperature $T_{cent}$ is in the range from 100° C. to less than 120° C., $\Delta T2$ is the temperature difference while the center portion temperature $T_{cent}$ is in the range from 80° C. to less than 100° C., $\Delta T3$ is the temperature difference while the center portion temperature $T_{cent}$ is in the range from 60° C. to less than 80° C., and $\Delta T4$ is the temperature difference while the center portion temperature $T_{cent}$ is less than 60° C.

The delay from when the end halogen lamp B is again turned ON to when the center halogen lamp A is again turned ON is shorter in S260 than in S230 because the temperature difference is less when the center portion temperature $T_{cent}$ is not in the range from 60° C. to less than 80° C., that is, when it is either less than 60° C. or greater than or equal to 120° C. (S140:NO), the procedure advances to S150, where the center halogen lamp A and the end halogen lamp B are turned ON simultaneously. When the center portion temperature $T_{cent}$ of the thermal roller 26 has cooled to this level, there is not much difference between the center portion temperature $T_{cent}$ and the end portion temperature $T_{end}$ of the thermal roller 26, and time cannot be saved even if the end halogen lamp B is turned ON prior to the center halogen lamp A.

As described above, the center portion of the thermal roller 26 is heated after the end portions when the center portion temperature $T_{cent}$ is judged to be greater than or equal to 60° C. and less than 80° C. (S140:YES). This results in a smaller temperature difference between the center and end portions than when the center halogen lamp A and the end halogen lamp B are turned ON simultaneously. Therefore, it is possible to re-start fixing with proper temperatures at both the center and end portions.

Further, the end halogen lamp B is turned ON earlier than the center halogen lamp A by a time that is greater when the center portion temperature $T_{cent}$ is in the range from 80° C. to less than 100° C. (three seconds) than when in either the range from 100° C. to less than 120° C. or the range from 60° C. to less than 80° C. (two seconds). Therefore, even when the temperature difference between the center and end portions is still quite large, that is, when the center portion temperature $T_{cent}$ is in the range of from 80° C. to less than 100° C., it is possible to re-start fixing operations at proper temperatures for both the center and end portions.

Figure 8:
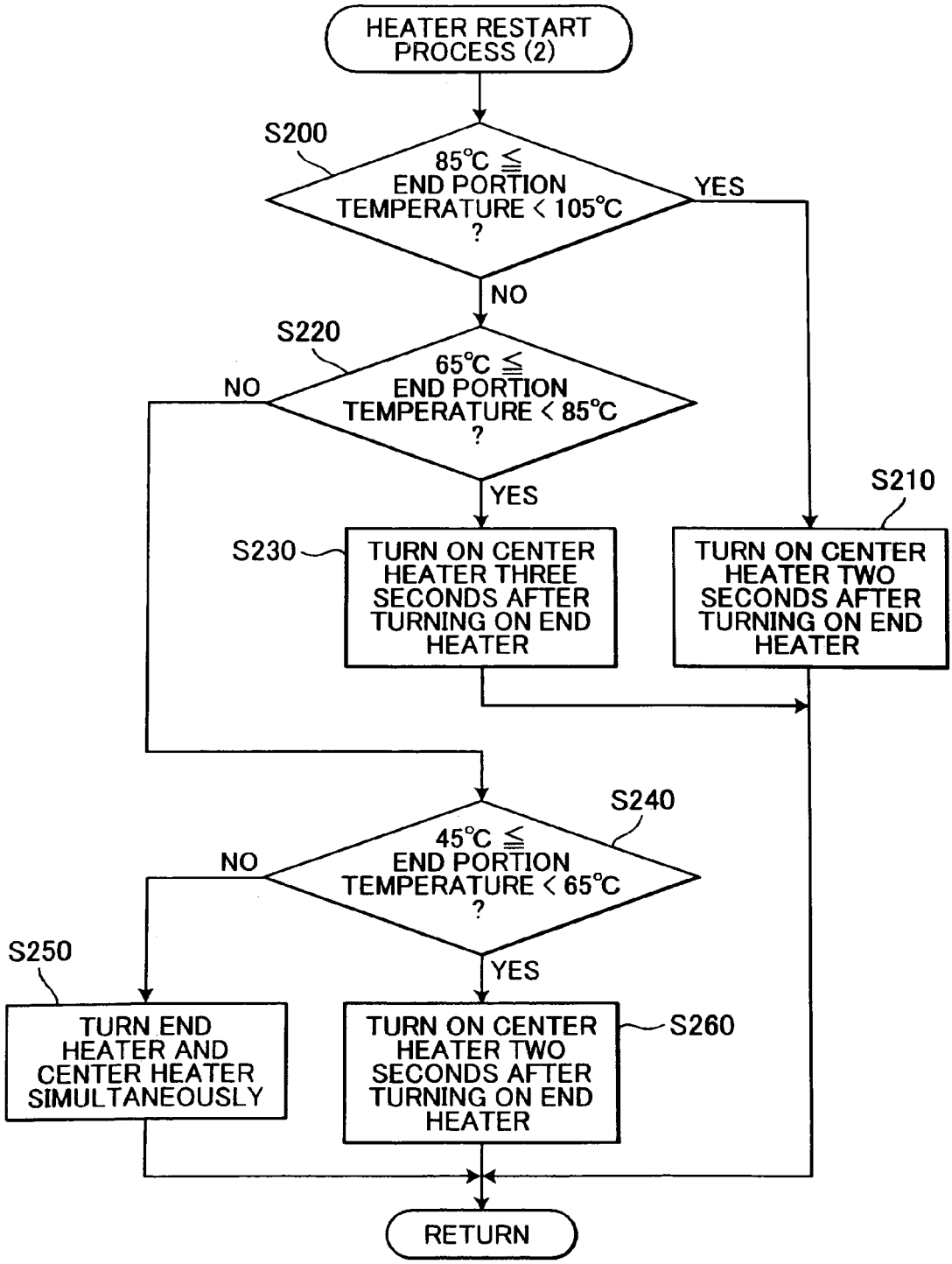
FIG. 8 is a flowchart representing a heater restart process (2) according to a modification of the embodiment.

Next, a first modification of the embodiment will be described. In the first modification, operations after turning the halogen lamps A and B back ON again are performed according to a heater restart process (2) represented by the flowchart in FIG. 8. This process is also started when the first and end halogen lamps A and B, once turned OFF, are restarted. In the heater restart process (2) the controller C uses the end portion temperature as the reference for when to turn ON the halogen lamps A and B, rather than center portion temperature as in the heater restart process (1).

When this process is started, a judgment is first made in S200 as to whether the end portion temperature $T_{end}$ of the thermal roller 26 as detected by the second temperature sensor 42 is in the range from 85° C. to less than 105° C. When it is in the range of from 85° C. to less than 105° C., the procedure advances to S210, where the center halogen lamp A is turned ON two seconds after the end halogen lamp B.

When the end portion temperature $T_{end}$ is not in the range from 85° C. to less than 105° C. (S200:No), the procedure advances to S220, where a judgment is made as to whether the end portion temperature $T_{end}$ is in the range from 65° C. to less than 85° C. When it is in the range from 65° C. to less than 85° C., the procedure advances to S230, where the center halogen lamp A is turned ON three seconds after turning ON the end halogen lamp B. When the end portion temperature $T_{end}$ is not in the range from 65° C. to less than 85° C. (S220:NO), the procedure advances to S240, where a judgment is made as to whether the end portion temperature $T_{end}$ is in the range from 45° C. to less than 65° C. When it is in the range from 45° C. to less than 65° C., the procedure advances to S260, where the center halogen lamp A is turned on two seconds after turning ON the end halogen lamp B. When the end portion temperature $T_{end}$ is not in the range from 45° C. to less than 65° C., that is, when it is either less than 45° C. or greater than or equal to 105° C., the procedure advances to S250, where the center halogen lamp A and the end halogen lamp B is turned ON simultaneously. The temperatures and the values are substantially of the same meaning as in the heater restart process (1). This process provides the same effect as that of the heater restart process (1).

Figure 9:
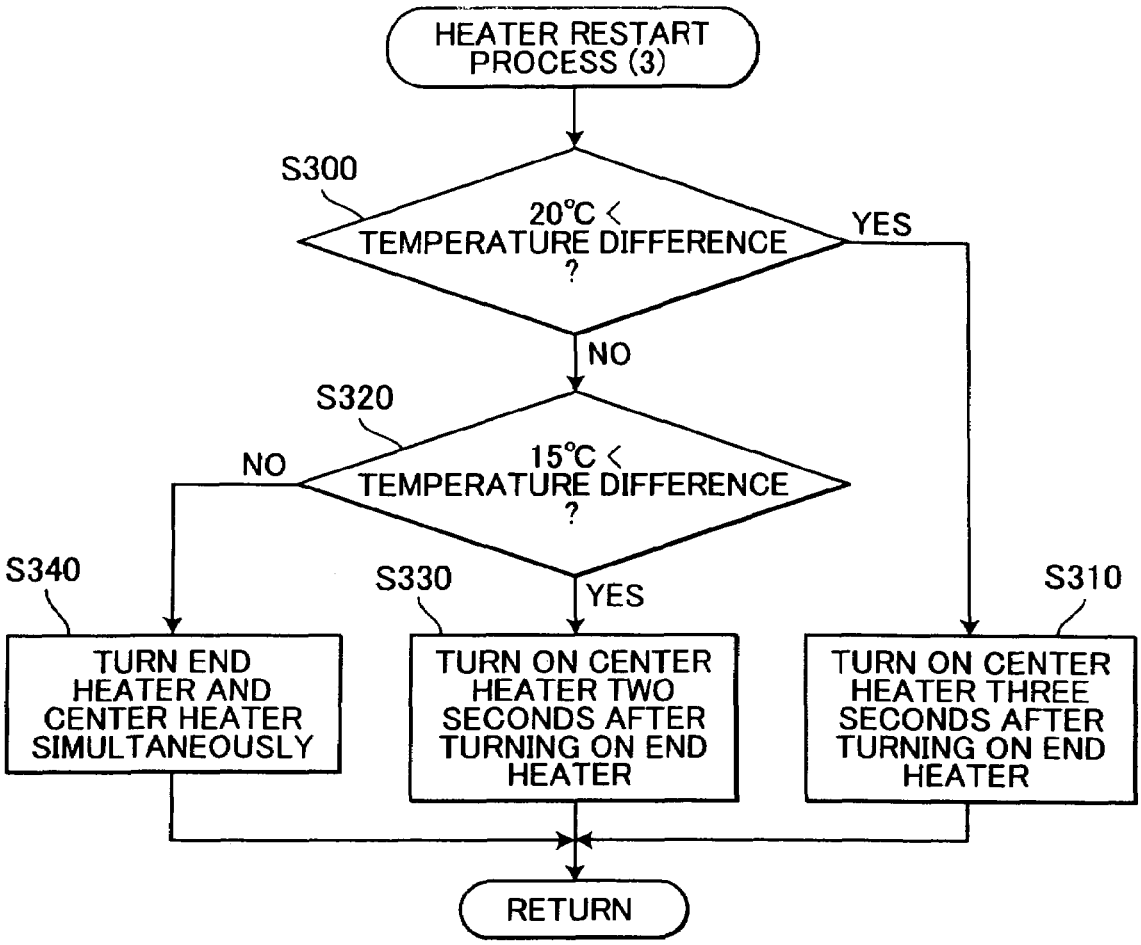
FIG. 9 is a flowchart representing a heater restart process (3) according to a second modification of the embodiment.

Next, a second modification of the embodiment will be described. In the second modification, operations after turning the halogen lamps A and B back ON again are performed according to a heater restart process (3) represented by the flowchart in FIG. 9. This process is also started when the first and end halogen lamps A and B, once turned OFF, are to be restarted. In the heater restart process (3), the controller C uses the difference between the center portion temperature $T_{cent}$ and the end portion temperature $T_{end}$ of the thermal roller 26 (alternately referred to as the temperature difference hereinafter) as the reference for judging when the halogen lamps A and B are turned ON. The temperature difference is calculated by subtracting the end portion temperature $T_{end}$ from the center portion temperature $T_{cent}$ (or vice versa).

When this process is started, a judgment is first made in S300 as to whether the temperature difference between the center portion temperature $T_{cent}$ and the end portion temperature $T_{end}$ of the thermal roller 26 exceeds 20° C. or not. When it exceeds 20° C., the procedure advances to S310, where the center halogen lamp A is turned ON three seconds after turning ON the end halogen lamp B.

When the temperature difference is not more than 20° C., the procedure advances to S320, where a judgment is made as to whether the temperature difference exceeds 15° C. or not. When it exceeds 15° C., the procedure advances to S330, where the center halogen lamp A is turned ON two seconds after turning ON the end halogen lamp B. When the temperature difference is not more than 15° C. (S320:NO), the procedure advance to S340, where the center halogen lamp A and the end halogen lamp B is turned ON simultaneously. This process provides the same effect as that of the heater restart process (1) and the heater restart process (2).

While an exemplary embodiment of this invention and its modifications have been described in detail, those skilled in the art will recognize that there are many further possible modifications and variations which may be made in these exemplary embodiments while yet retaining many of the novel features and advantages of the invention.

For example, the embodiment describes the present invention applied to the thermal fixing device 18 and the laser printer 1. However, this should not be construed restrictively, and various modifications are possible. For example, the present invention may be applied not to the thermal fixing device of the laser printer 1 but to the thermal fixing device of a laminator. While in the above description of the processing specific values, such as 100° C. and two seconds, are given, they are only given by way of example; such values vary according to the toner characteristics and the construction of the thermal fixing device 18. The temperature and delay time should be set to proper values in correspondence with the toner characteristics and the device construction.

Further, the time lag that the center halogen lamp A is turned ON after the halogen lamp B can be determined based on the temperature difference between the center and end portions of the thermal roller 26. That is, the temperature difference between the center and end portions of the thermal roller 26 is measured starting from when the end halogen lamp B is turned back ON from the sleep mode. The halogen lamp A is turned ON once the temperature difference is determined to be smaller than the temperature difference used during printing operations. With this configuration, the thermal fixing device can be placed in a minimal time in a state in which fixing is possible.

It is also possible for the thermal fixing device to be equipped with a heater other than the end heater and the center heater. For example, it is possible to provide heaters for heating intermediate portions between the axial center and the ends of the fixing member.

Although, the embodiment describes providing two temperature sensors 41, 42, the present invention is not limited to this configuration. For example, it is also possible to prepare a table that represents the cooling characteristics of different portions of the thermal roller. The table may include various parameters, such as elapsed time and room temperature, that effect how the difference portions of the thermal roller will cool down after the lamps A, B are turned OFF. The delay time for driving the center lamp A after the end lamp B is then determined based on the information in the table.

Also, the embodiment describes that the end halogen lamp B heats both axial ends of the roller main body 32. However, this is not to be considered a limitation of the present invention. For example, the halogen lamp A can be shifted to one axial end of the roller main body 32 to heat a main portion of the roller main body 32 and the end halogen lamp B can be designed to heat only the end portion of the roller main body 32 that is not heated by the halogen lamp A. A thermal fixing device with this configuration is capable of fixing toner onto different sized sheets as well. Also, other heaters besides halogen lamps can be used.

What is claimed is:

1. A thermal fixing device that performs fixing operations to thermally fix one medium to another medium, the thermal fixing device performing a first fixing operation before a second fixing operation with a non-fixing time interval in between, the thermal fixing device comprising:

a fixing member that during each fixing operation thermally fixes one medium to another medium, the fixing member being elongated in an elongated direction and having a main portion and an end portion aligned side by side with respect to the elongated direction;

a main heater that heats the main portion of the fixing member;

an end heater that heats the end portion of the fixing member; and a heater controller that drives the main heater and the end heater to heat up the main portion and the end portion of the fixing member to within a fixing temperature range during the first fixing operation and that stops driving the main heater and the end heater during the non-fixing interval, the heater controller driving the end heater at start of the second fixing operation, and then driving the main heater when a time lag elapses after starting drive of the end heater.

2. The thermal fixing device as claimed in claim 1, further comprising an end portion temperature detector that, at start of the second fixing operation, detects whether the end portion is at least one of a high temperature and a low temperature, the high temperature being higher than the low temperature, the heater controller driving the main heater after a time lag in the second fixing operation that is longer when the end portion temperature detector detects that the end portion is at the high temperature than when the end portion temperature detector detects that the end portion is at the low temperature.

3. The thermal fixing device as claimed in claim 2, wherein the end portion temperature detector further detects whether the end portion is at a temperature that is lower than the low temperature, the heater controller starting drive of the end heater and the main heater simultaneously in the second fixing operation when the end portion temperature detector detects that the end portion is at the temperature that is lower than the low temperature.

4. The thermal fixing device as claimed in claim 2, wherein the end heater includes a halogen lamp that emits light to heat up the fixing member, the halogen lamp emitting different intensity light at different positions thereof, the halogen lamp emitting a peak intensity light from a peak emitting position thereof, the end portion temperature detector detecting temperature of the fixing member at a position that corresponds to the peak emitting position of the halogen lamp.

5. The thermal fixing device as claimed in claim 1, further comprising a main portion temperature detector that, at start of the second fixing operation, detects whether the main portion is at least one of a high temperature and a low temperature, the high temperature being higher than the low temperature, the heater controller driving the main heater after a time lag in the second fixing operation that is longer when the main portion temperature detector detects that the main portion is at the high temperature than when the main portion temperature detector detects that the main portion is at the low temperature.

6. The thermal fixing device as claimed in claim 5, wherein the main portion temperature detector further detects whether the main portion is at a temperature that is lower than the low temperature, the heater controller starting drive of the end heater and the main heater simultaneously in the second fixing operation when the main portion temperature detector detects that the main portion is at the temperature that is lower than the low temperature.

7. The thermal fixing device as claimed in claim 5, wherein the main heater includes a halogen lamp that emits light to heat up the fixing member, the halogen lamp emitting different intensity light at different positions thereof, the halogen lamp emitting a peak intensity light from a peak emitting position thereof, the main portion temperature detector detecting temperature of the fixing member at a position that corresponds to the peak emitting position of the halogen lamp.

8. The thermal fixing device as claimed in claim 1, further comprising a temperature difference detector that detects, at start of the second fixing operation, whether a temperature difference between the main portion and the end portion of the fixing member is at least one of a high temperature difference and a low temperature difference, the high temperature difference being greater than the low temperature difference, the heater controller driving the main heater in the second fixing operation after a time lag that is longer when the temperature difference detector detects that the temperature difference is the high temperature difference than when the temperature difference detector detects that the temperature difference is the low temperature difference.

9. The thermal fixing device as claimed in claim 8, wherein the temperature difference detector further detects when the temperature difference is a temperature difference that is lower than the low temperature difference, the heater controller starting drive of the end heater and the main heater simultaneously in the second fixing operation when the temperature difference detector detects the temperature difference that is lower than the low temperature difference.

10. The thermal fixing device as claimed in claim 8, wherein the end heater includes a halogen lamp that emits light to heat up the fixing member, the halogen lamp emitting different intensity light at different positions thereof, the halogen lamp emitting a peak intensity light from a peak emitting position thereof, the end portion temperature detector detecting temperature of the fixing member at a position that corresponds to the peak emitting position of the halogen lamp.

11. The thermal fixing device as claimed in claim 1, wherein the heater controller, during the first fixing operation, drives the main heater to heat up the main portion to a fixing main temperature and drives the end heater to heat up the end portion to a fixing end temperature, the fixing main temperature and the fixing end temperature differing by a fixing temperature difference, further comprising a temperature difference detector that detects whether a temperature difference between the main portion and the end portion of the fixing member is smaller than the fixing temperature difference, the heater controller waiting for a time lag until the temperature difference detector detects the temperature difference that is smaller than fixing temperature difference.

12. The thermal fixing device as claimed in claim 1, wherein the fixing member is a heat roller.

13. An image forming device comprising:

an image forming unit that performs a prior image forming operation and a subsequent image forming operation consecutively to form images on a recording medium, the image forming unit performing the prior image forming operation before performing the subsequent image forming operation;

a thermal fixing device that thermally fixes the images onto the recording medium, the thermal fixing device including:

a fixing member that thermally fixes one medium to another medium, the fixing member being elongated in an elongated direction and having a main portion and an end portion aligned side by side with respect to the elongated direction;

a main heater that heats the main portion of the fixing member; and an end heater that heats the end portion of the fixing member; and a thermal fixing device controller that selectively turns the main heater and the end heater on while the image forming unit performs the prior image forming operation and off after the image forming unit completes the prior image forming operation and, before the image forming unit performs the subsequent image forming operation, turns the end heater on before turning the main heater on.

14. A method of controlling a thermal fixing device, the thermal fixing device including a fixing member, a main heater, and an end heater, the fixing member thermally fixing one medium to another medium, the fixing member being elongated in an elongated direction and having a main portion and an end portion aligned side by side with respect to the elongated direction, the main heater heating the main portion of the fixing member, the end heater heating the end portion of the fixing member, the method comprising:

driving the main heater and the end heater to heat up the main portion and the end portion of the fixing member to within a fixing temperature range to perform a first fixing operation;

stopping drive of the main heater and the end heater during a non-fixing interval after the first fixing operation is completed;

driving the end heater at start of a second fixing operation after the first fixing operation and the non-fixing interval; and driving the main heater when a time lag elapses after starting drive of the end heater.

15. A thermal fixing device comprising:

a fixing member that thermally fixes one medium to another medium;

a first heater that heats the fixing member;

a second heater that heats the fixing member;

a first temperature detector that detects a temperature of a portion of the fixing member;

a second temperature detector that detects a temperature of another portion of the fixing member, and a heater controller that determines a difference between the temperature detected by the first temperature detector and the second temperature detector and drives the first heater and the second heater to heat up the fixing member to within a fixing temperature, wherein the heater controller determines a length of a time lag based on the difference between the temperature detected by the first temperature detector and the second temperature detector at starting drive of the first heater and the second heater, starts driving the first heater, and then starts driving the second heater when the time lag elapses after starting drive of the first heater.

16. The thermal fixing device as claimed in claim 15, wherein the heater controller determines the length of the time lag before starting drive of the first heater and the second heater.

17. The thermal fixing device as claimed in claim 15, wherein the fixing member is elongated in an elongated direction and has a main portion and an end portion aligned side by side with respect to the elongated direction, and the first temperature detector detects a first temperature of the main portion and the second temperature detector detects a second temperature of the end portion.

18. An image forming device comprising:

an image forming unit that forms images on a recording medium;

a thermal fixing device including:

a fixing member that thermally fixes the image onto the recording medium;

a first heater that heats the fixing member;

a second heater that heats the fixing member;

a first temperature detector that detects a temperature of a portion of the fixing member; and a second temperature detector that detects a temperature of another portion of the fixing member; and a thermal fixing device controller that determines a difference between the temperature detected by the first temperature detector and the second temperature detector and drives the first heater and the second heater to heat up the fixing member to within a fixing temperature, wherein the thermal fixing device controller determines a length of a time lag based on the difference between the temperature detected by the first temperature detector and the second temperature detector at starting drive of the first heater and the second heater, starts driving the first heater, and then starts driving the second heater when the time lag elapses after starting drive of the first heater.

19. The image forming device as claimed in claim 18, wherein the thermal fixing device controller determines the length of the time lag before starting drive of the first heater and the second heater.

20. The image forming device as claimed in claim 18, wherein the fixing member is elongated in an elongated direction and has a main portion and an end portion aligned side by side with respect to the elongated direction, the first temperature detector detects a first temperature of the main portion and the second temperature detector that detects a second temperature of the end portion.

21. A method of controlling a thermal fixing device, the thermal fixing device including a fixing member, a first heater, a second heater, a first temperature detector, and a second temperature detector, the fixing member thermally fixing one medium to another medium, the first heater heating the fixing member, the second heater heating the fixing member, the first temperature detector detecting a temperature of a portion of the fixing member, the second temperature detector detecting a temperature of another portion of the fixing member, the method comprising:

detecting a temperature of the portion and the another portion of the fixing member;

determining a length of a time lag based on a difference between the temperature of the portion and the another portion of the fixing member;

starting drive of the first heater; and starting drive of the second heater when the time lag elapses after starting drive of the first heater.

* * * * *